US007213555B2

(12) United States Patent
Kamimura et al.

(10) Patent No.: US 7,213,555 B2
(45) Date of Patent: May 8, 2007

(54) AUTOMATIC CHOKE

(75) Inventors: Kenji Kamimura, Saitama (JP); Kouichi Asai, Saitama (JP); Masashi Nakamura, Saitama (JP); Minoru Tamura, Saitama (JP); Tomoki Fukushima, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 134 days.

(21) Appl. No.: 11/075,728

(22) Filed: Mar. 10, 2005

(65) Prior Publication Data

US 2005/0200030 A1 Sep. 15, 2005

(30) Foreign Application Priority Data

Mar. 12, 2004 (JP) ..... 2004-070561
Mar. 18, 2004 (JP) ..... 2004-078163

(51) Int. Cl.
*F02M 1/08* (2006.01)
*F02M 1/10* (2006.01)

(52) U.S. Cl. ..... 123/179.18; 261/39.1; 261/64.6; 123/339

(58) Field of Classification Search ..... 123/337, 123/179.16, 179.18, 399, 403; 251/305, 251/128.11; 261/39.1, 64.6
See application file for complete search history.

(56) References Cited

U.S. PATENT DOCUMENTS 3,948,240 A * 4/1976 Hirosawa et al. ..... 123/179.16
4,011,844 A * 3/1977 Hirosawa et al. ..... 261/39.6
4,321,902 A * 3/1982 Stoltman ..... 123/435
4,463,723 A * 8/1984 Tansuwan ..... 123/438
4,524,742 A * 6/1985 Bonfiglioli et al. ..... 123/438
4,623,322 A * 11/1986 Melchior ..... 464/160

FOREIGN PATENT DOCUMENTS

JP 02238162 A * 9/1990
JP 2-280425 10/1993

* cited by examiner

*Primary Examiner*—Noah P. Kamen
*Assistant Examiner*—Arnold Castro
(74) *Attorney, Agent, or Firm*—Westerman, Hattori, Daniels & Adrian, LLP.

(57) ABSTRACT

A choke valve is controlled finely suited to the running state of an engine. A throttle valve 8 and a choke valve 9 are provided in series on an intake pipe 6, and the opening degree of the choke valve 9 is controlled by a stepping motor. The choke valve opening degree upon start of engine (start opening degree) is determined depending on the engine temperature. The stepping motor 11 is initialized at the fully closed side of the choke valve 9 when the power source for starting the engine is turned on. The start opening degree of the choke valve is judged to be closer to the fully closed side or fully opened side, and the stepping motor 11 is initialized at the fully closed side if judged to be close to the fully closed side, and at the fully opened side if at the fully opened side.

6 Claims, 6 Drawing Sheets

Fig. 7

| | ENGINE TEMPERATURE (° C) | | | | | | | | | | | | | |
|---|---|---|---|---|---|---|---|---|---|---|---|---|---|---|
| | -25 | -20 | -15 | -10 | 0 | 10 | 20 | 30 | 40 | 50 | 60 | 70 | 80 | 80< |
| WORKING TIME FROM START OPENING DEGREE TO HALF OPEN (sec) | 40 | 15 | 10 | 7 | 4 | 2 | 2 | 1 | 1 | 1 | — | — | — | — |
| WORKING TIME FROM HALF OPEN TO FULLY OPEN (sec) | 50 | 25 | 20 | 12 | 5 | 2 | 1 | 1 | 1 | 1 | 1 | 1 | 1 | 1 |
| TOTAL TIME UNTIL CHOKE VALVE FULLY OPENS AFTER ENGINE START (sec) | 90 | 40 | 30 | 19 | 9 | 4 | 3 | 2 | 2 | 2 | 1 | 1 | 1 | 1 |

AUTOMATIC CHOKE

BACKGROUND OF THE INVENTION

1. Field of the Invention

The present invention relates to an automatic choke, and more particularly to an automatic choke capable of controlling air-fuel ratio favorably corresponding to temperature in the process of engine temperature rise after starting.

2. Description of the Related Art

An automatic choke used when starting a cold engine is designed to control a solenoid actuator or diaphragm actuator for operating a choke valve according to the temperature detected by a temperature detecting element such as thermostat. When starting a cold engine, by controlling the air-fuel ratio in a direction of concentrating the mixed air by the automatic choke, the engine can be started stably.

For example, Japanese Patent Application Laid-Open No. 5-280425 relates to a case of detecting a cold engine by a sensor composed of thermistor for issuing a detection signal corresponding to the temperature of the cylinder head, and discloses an automatic choke in which the choke solenoid is automatically actuated only in cold state for actuating the choke when starting up the engine, while the throttle valve is fully closed.

As in the device disclosed in the patent document, it is general to control the choke valve by using solenoid actuator. However, since the solenoid is controlled either in on or off state, near the end of the choke period, that is, when the necessary choke period is nearly over, it tends to be over-choke (insufficient opening of choke valve).

By contrast, using a bimetal as an actuator, it has been attempted to control the choke valve continuously. However, since the bimetal is poor in response to temperature changes, the choke releasing timing is delayed both when starting a cold engine and when restarting a warm engine, thus it only consumes time while sufficient output is not obtained.

SUMMARY OF THE INVENTION

It is hence an object of the present invention to present an automatic choke capable of controlling the choke valve accurately and finely while following up the engine temperature.

It is a first aspect of the invention to present an automatic choke for controlling the opening degree of a choke valve provided in an intake passage of engine upon start of engine in which it comprises a stepping motor is provided for controlling the opening degree of the choke valve, wherein the choke valve is driven to the fully closed side for initializing the stepping motor when the power source for starting the engine is turned on.

It is a second aspect of the invention to present the automatic choke, in which the opening degree of the choke valve upon start of engine is determined on the basis of the temperature information representing the engine temperature upon start of engine, and the time until releasing the choke corresponding to fully opening the choke valve from the opening degree of the choke valve upon start of engine is determined on the basis of the temperature information.

It is a third aspect of the invention to present the automatic choke, in which a stepping motor is provided for controlling the opening degree of the choke valve, wherein the choke valve is driven to the fully closed side when the preset start opening degree of the choke valve is at the fully closed side from the reference opening degree and the choke valve is driven to the fully opened side when the preset start opening degree of the choke valve is at the fully opened side from the reference opening degree, for initializing the stepping motor when the power source for starting the engine is turned on.

According to the first aspect of the invention, the stepping motor driven in open loop can be securely initialized to fully closed side of the choke valve. Since the stepping motor has been initialized at the fully closed side of the choke value so as to be appropriate when starting up, the choke valve can be quickly turned to the preset opening degree upon start.

According to the second aspect of the invention, the engine is started at a proper opening degree of the choke valve determined depending on the engine or engine ambient temperature. Since the choke is released gradually by the stepping motor, over-choke and drop of air-fuel ratio near the end of choke valve fully opened side can be suppressed.

According to the third aspect of the invention, when starting the stepping motor driven in open loop, it can be initialized securely. In particular, depending on whether the start opening degree of the choke valve is closer to the fully closed side or to the fully opened side from the reference opening degree, the stepping motor for driving the choke valve is initialized either at the fully closed side or at the fully opened side of the choke valve. That is, since the choke valve is positioned and initialized preliminarily at the start opening degree side, after initializing the stepping motor, the choke valve can be moved in a short time up to the start opening degree. Therefore, after manipulation for engine start, the choke valve can be immediately moved to the start opening degree, and the starting performance is enhanced.

BRIEF DESCRIPTION OF THE DRAWINGS

FIG. 7 is a diagram showing an example of a choke release time corresponding to the engine temperature.

DETAILED DESCRIPTION OF THE PREFERRED EMBODIMENTS

Figure 1:
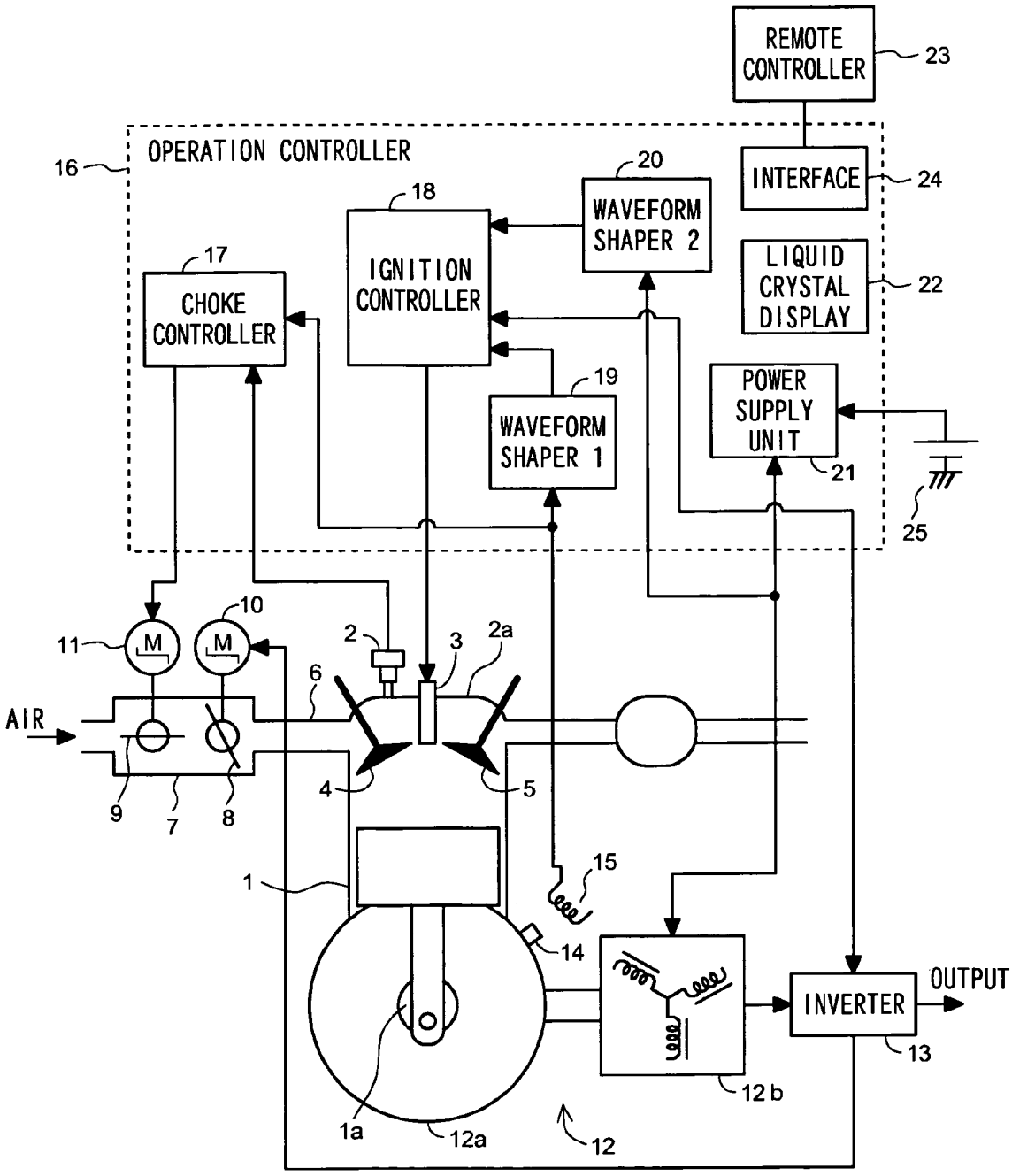
FIG. 1 is a block diagram of system configuration of an automatic choke in an embodiment of the present invention.

Referring now to the drawings, the invention is specifically described below. FIG. 1 is a block diagram of system configuration of an automatic choke in an embodiment of the present invention. In the diagram, an engine 1 is used as a driving source of a generator. The engine 1 includes a temperature sensor 2 for detecting the engine temperature. The temperature sensor 2 is provided, for example, on a cylinder head 2*a*. The cylinder head 2*a* includes an ignition plug 3, an intake valve 4, and an exhaust valve 5.

A carburetor 7 is connected to an intake tube 6 having the intake valve 4. The carburetor 7 includes a throttle valve 8 disposed at the downstream side, and a choke valve 9 disposed at its upstream. The throttle valve 8 is driven by a stepping motor 10 and opened or closed, and the choke valve 9 is driven by a stepping motor 11 and opened or closed.

The engine 1 is coupled to a generator 12. The generator 12 is driven by the engine 1, and generates alternating current. This alternating current is rectified, and converted into a specified frequency (commercial frequency of 50 or 60 Hz) by an inverter 13, and a commercial supply voltage is produced.

The generator 12 serving also as starter motor of the engine 1 comprises an outer rotor 12*a* having a magnet mounted on the inner circumference of a flywheel coupled to a crankshaft 1*a* of the engine 1, and a stator 12*b* on which power generating coil is wound. The crankshaft 1*a* may be coupled to a recoil starter (not shown) for manual starting.

The outer rotor 12*a* of the generator 12 includes a reluctor 14 for detection of ignition timing, and a before top dead center sensor (BTDC sensor) 15 for detecting the reluctor 14 is provided around the outer rotor 12*a*.

The ignition timing of the ignition plug 3 and opening degree of the choke valve 9 are controlled by an operation controller 16. A choke controller 17 outputs a control signal for driving the stepping motor 11 depending on the engine temperature detected by the temperature sensor 2 and the engine speed detected by the output of the BTDC sensor 15. According to this control signal, the stepping motor 11 operates the choke valve 9 so as to obtain an appropriate the air-fuel ratio corresponding to the temperature. The control operation of the choke controller 17 is described later.

The stepping motor 10 is controlled by an electronic governor so as to maintain the engine speed at a specified reference speed. The reference speed is variable with the magnitude of the load (the electrical load connected to the output side of the inverter 13).

An ignition controller 18 controls the ignition timing appropriately on the basis of the alternating-current waveforms of the BTDC sensor 15 and generator 12. Waveform shapers 19, 20 shape the output waveform from the BTDC sensor 15 and alternating-current output waveform from the generator 12, respectively. The ignition timing is controlled by the timing of waveform supplied from the waveform shapers 19, 20, but this is not essential point of the invention and the detail is omitted.

A power supply unit 21 supplies necessary power to the operation controller 16, and includes a battery 25, and a regulator for regulating the rectified voltage of the generator 12 (input side voltage of the inverter 13) at specified voltage. The operation controller 16 may also include a liquid crystal display 22 for displaying the running state of the generator 12 and the like. For remote control of the generator 12, an interface 24 may be provided for connection of a remote controller 23. The choke controller 17 and ignition controller 18 may be composed of microcomputers.

Figure 2:
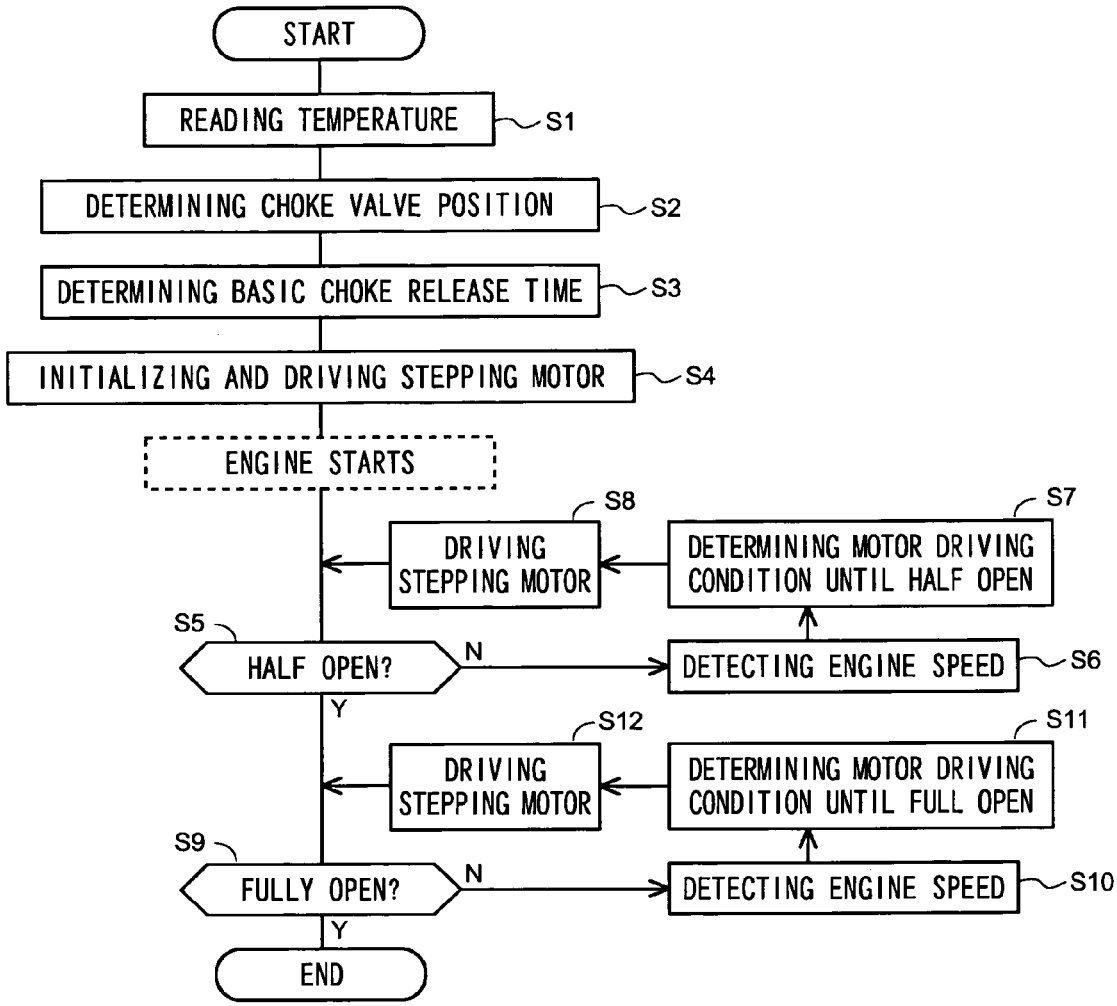
FIG. 2 is a flowchart of operation of a choke control unit.

FIG. 2 is a flowchart of operation of the choke controller 17. This process is started when the power supply unit 21 is energized by the electric power supplied from the battery 25. When the battery 25 has been overdischarged, the engine 1 is turned by the recoil starter, and the power supply unit 21 is energized by the power generation output from the generator 12 at this time.

Figure 5:
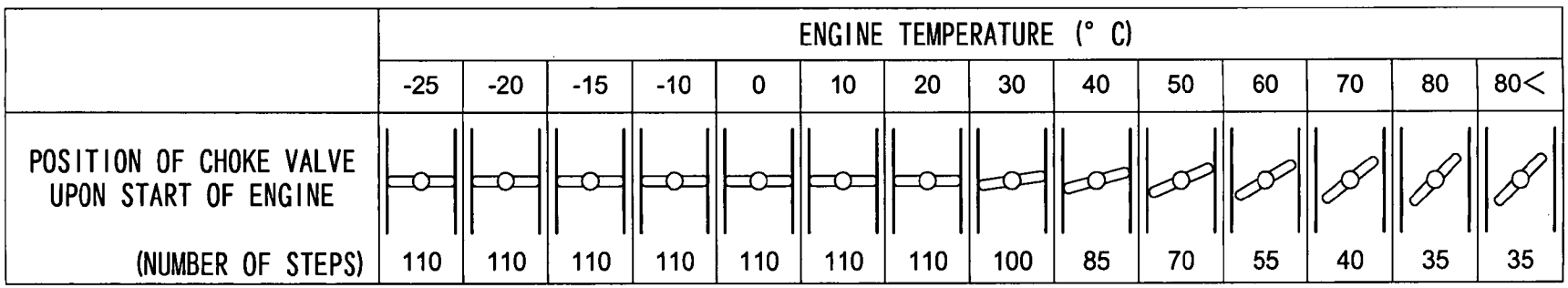
FIG. 5 is a diagram showing position of the choke valve at various engine temperature levels upon start of the engine.

First, at step S1, the detected temperature by the temperature sensor 2 is read in. At step S2, the position of the choke valve 9 (start opening degree or start opening angle) corresponding to the detected temperature is determined. The start opening degree is read out, for example, from a predetermined table as shown in FIG. 5. The position of the choke valve 9 is indicated by the number of steps to be supplied to the stepping motor 11. The detail of FIG. 5 is described later.

At step S3, for example using a predetermined table as shown in FIG. 7, the working time until release of choke corresponding to the engine temperature (basic choke release time) is determined. The detail of FIG. 7 is described later.

At step S4, first the stepping motor 11 is driven in order to initialize, and the stepping motor 11 is driven for rotating the choke valve 9 until start opening degree.

For initialization of the stepping motor 11, for example, as described specifically below, a driving signal of a predetermined number of steps is supplied to the stepping motor 11 so as to move the choke valve 9 to the fully closed side. In consequence, the choke valve 9 is fully closed. The start opening degree of the choke valve 9 is determined on the basis of this fully closed position.

When starting up the engine by driving the starter motor by battery, after initialization of the stepping motor 11, the choke valve 9 is moved to the start opening degree, and then the engine is started. On the other hand, when power cannot be supplied from battery, since the stepping motor 11 is driven and ignited by the power generation output obtained by manual revolution by the recoil starter, driving of the choke valve 9 and start of the engine are executed almost at the same time.

After the engine startup, at step S5, it is judged whether the choke valve 9 is opened to half or not. This is judged by the number of pulses supplied to the stepping motor 11 or by the number of steps of the driving signal. If the choke valve 9 is opened to less than half, advancing to step S6, the engine speed is detected. The engine speed can be detected on the basis of the output period of the BTDC sensor 15, but the method of detection is not particularly specified. At step S7, the motor driving condition until the choke valve 9 is opened to half is determined.

In determination of motor driving condition until half open, the basic choke release time determined at step S3 (working time from start opening degree to half open) is corrected. In this correction, as the engine speed is higher, the basic choke release time is shortened, and as the engine speed is lower, the basic choke release time is extended.

The number of driving pulses supplied to the stepping motor 11 in every driving period (for example, 0.7 sec) is determined on the basis of this driving period and the basic choke release time extended or shortened corresponding to increase or decrease of engine speed. When the number of pulses supplied per driving period is increased, it is fast to move to the choke release side, whereas if the number of pulses supplied per driving period is decreased, it is slow to move to the choke release side.

In this way, at step S7, the number of pulses or number of steps in every driving period to be supplied to the stepping motor 11 until the choke valve 9 is opened half from start opening degree is determined, and at step S8, the stepping motor 11 is driven in the determined motor driving condition (determined number of driving pulses or number of steps).

If it is judged at step S5 that the choke valve 9 is open to half, skipping to step S9, it is judged if the choke valve 9 is fully opened or not. Same as in judgement of half open, it is determined by the number of pulses or the number of steps supplied to the stepping motor 11.

If the choke valve 9 is not fully opened, going to step S10, the engine speed is detected. At step S11, the motor driving condition until the choke valve 9 is opened fully is determined. At step S11, too, same as at step S7, the basic choke release time by the engine speed (working time from half open to full open) is corrected, and the number of output driving pulses or number of steps in every driving period on the stepping motor 11 is calculated. At step S12, the stepping motor 11 is driven in the determined motor driving condition (determined number of pulses or number of steps). When the choke valve 9 is judged to be fully opened, this choke control is terminated.

As mentioned above, by driving the choke valve 9 by a specified amount in the fully closing direction at step S4, and this position is determined as the initial position of the stepping motor 11. As a result, the following effects are brought about. For example, due to overdischarge of a battery 25, if power cannot be supplied to the generator 12 for operating as starter motor from the power supply unit 21, the recoil starter is operated to start the engine. In this case, if failing to start by the recoil starter, and no power is supplied until the choke valve 9 is fully closed, by such initialization of the choke valve 9, the position of the choke valve 9 is at leased moved in the fully closing direction. Hence, it is easier to start the engine, and possibility of engine start is higher by next attempt to start.

For initialization of the stepping motor 11, the timing of driving the choke valve 9 in the fully closing direction is not specified, and it may be executed at the first step in this flowchart. In short, to set the choke valve 9 at the start opening degree, the stepping motor 11 may be initialized at the fully closed side of the choke opening degree until the stepping motor 11 is driven.

Figure 3:
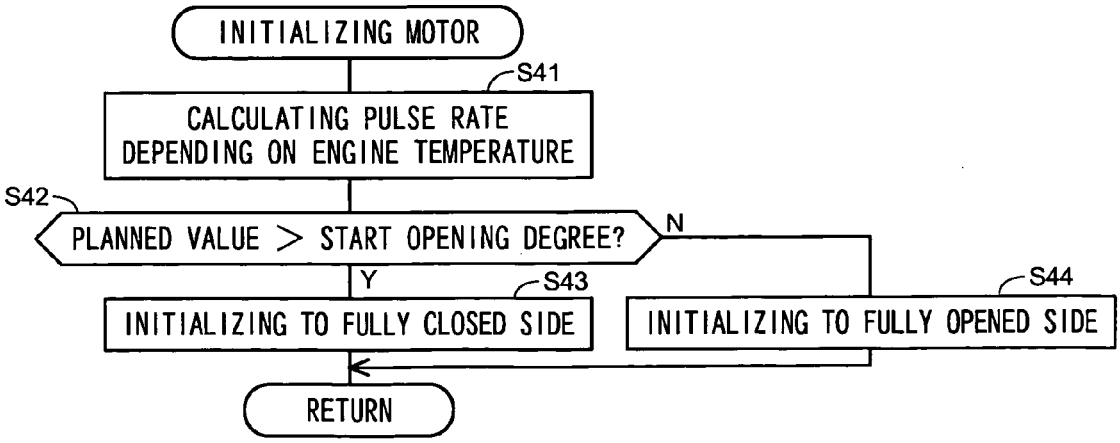
FIG. 3 is a flowchart of modified example of initializing process of a stepping motor.

A modified example of initialization of stepping motor 11 at step S4 is explained. FIG. 3 is a flowchart of modified example of initialization of the stepping motor 11.

Figure 4:
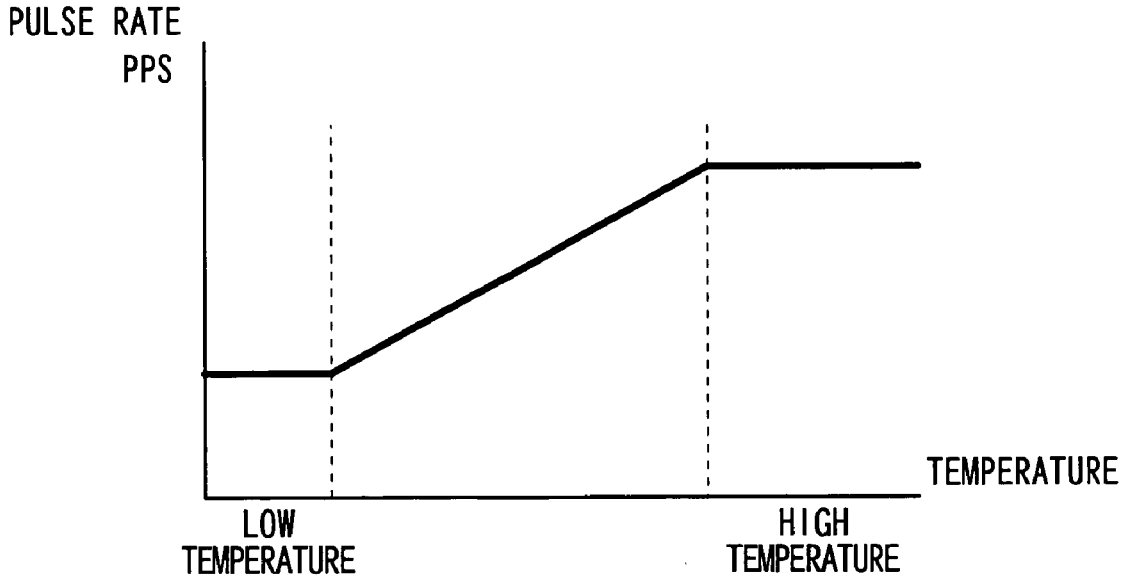
FIG. 4 is a table showing an example of pulse rate of the stepping motor corresponding to the engine temperature.

In the diagram, at step S41, the pulse rate of the stepping motor 11 is determined depending on the engine temperature. An example of setting table of pulse rate of the stepping motor 11 in relation to temperature is shown in FIG. 4.

At step S42, it is judged if the start opening degree determined at step S2 is less than the predicted value (for example, half open). If the start opening degree is less than half open, the process goes to step S43, and if the start opening degree is half open or more, the process goes to step S44.

At step S43, the stepping motor 11 is initialized at the fully closed side of the choke valve 9. That is, the choke valve 9 is turned to the fully closed side at the pulse rate determined at step S41. At step S44, the stepping motor 11 is initialized at the fully opened side of the choke valve 9. That is, the choke valve 9 is turned to the fully opened side at the pulse rate determined at step S41.

In this manner, when the start opening degree determined on the basis of engine temperature is at fully closed side, the choke valve 9 is driven to fully closed position, where the stepping motor 11 is initialized. On the other hand, when the start opening degree determined on the basis of the engine temperature is at fully opened side, the choke valve 9 is driven to fully opened position, where the stepping motor 11 is initialized. Thus, since initialization takes place at a side closer to the start opening degree, the choke valve 9 can be moved to the start opening degree in a shorter time after initialization.

FIG. 5 shows the position or start opening degree of the choke valve 9 at various engine temperatures upon start of engine, expressed by the number of steps of the stepping motor 11. In this example, the choke valve 9 is fully closed (number of steps=110) in an engine temperature range of minus 25° C. to 20° C., and the choke valve 9 is slightly open at engine temperature of 30° C. or higher. The choke valve 9 is half open (number of steps=55) at engine temperature of 60° C., and at higher temperatures the choke valve 9 is opened gradually up to the number of steps of 35.

As understood from this diagram, in the modified example of initialization, since at the engine temperature of 60° C. or less, the start opening degree is at closed side from the half open state, the stepping motor 11 is initialized at the fully closed side of the choke valve 9. Since at the engine temperature of 60° C. or higher, the start opening degree is at opened side from the half open state, and the stepping motor 11 is initialized at the fully opened side of the choke valve 9.

Figure 6:
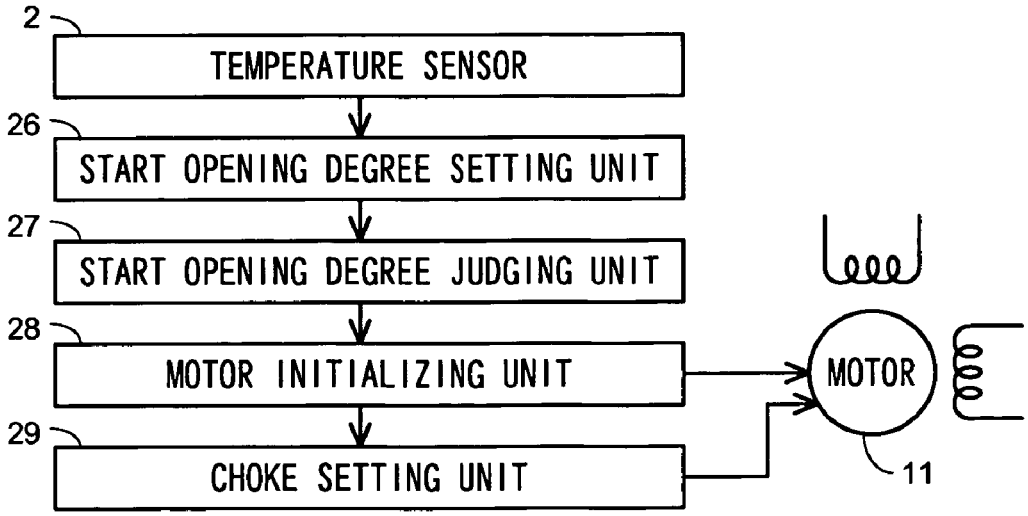
FIG. 6 is a block diagram of essential functions of a choke controller.

FIG. 6 is a block diagram of essential functions of the choke controller 17 of the embodiment. In a start opening degree setting unit 26, the start opening degree of the choke valve 9 corresponding to the engine temperature shown in FIG. 5 is set, and the value of start opening degree corresponding to the engine temperature detected by the temperature sensor 2 is issued. A start opening degree judging unit 27 reads the start opening degree from the start opening degree setting unit 26, and judges whether at the fully closed side or fully opened side from the planned opening degree (for example, opening degree corresponding to half open).

A motor initializing unit 28 supplies a specified number of driving signals for moving the stepping motor 11 to the fully closed position of the choke valve 9 when the start opening degree is at the fully closed side, to the stepping motor 11. On the other hand, the motor initializing unit 28 supplies a specified number of driving signals for moving the stepping motor 11 to the fully opened position of the choke valve 9 when the start opening degree is at the fully opened side, to the stepping motor 11.

When the stepping motor 11 is initialized by supplying the preset number of steps of driving signals for fully closing or fully opening to the stepping motor 11, then a choke setting unit 29 supplies the number of steps of driving signals corresponding to the start opening degree to the stepping motor 11, and sets the choke valve 9 at start opening degree.

FIG. 7 is an example showing choke release time corresponding to the engine temperature. This is an example of basic choke release time when the engine speed is controlled by an electronic governor to be at reference speed of 3300 rpm. Therefore, if the reference speed varies with fluctuations of the load connected to the generator 12, the basic choke release time (working time until half open, and working time from half open to full open) is corrected depending on the engine speed. That is, when the load increases and the engine speed changes somewhat higher than the reference speed, the choke release time is shortened, and when the load decreases and the engine speed changes somewhat lower than the reference speed, the choke release time is extended. Thus, the choke release time is corrected to be appropriate depending on the running condition of the generator 12, that is, the engine 1.

Figure 8:
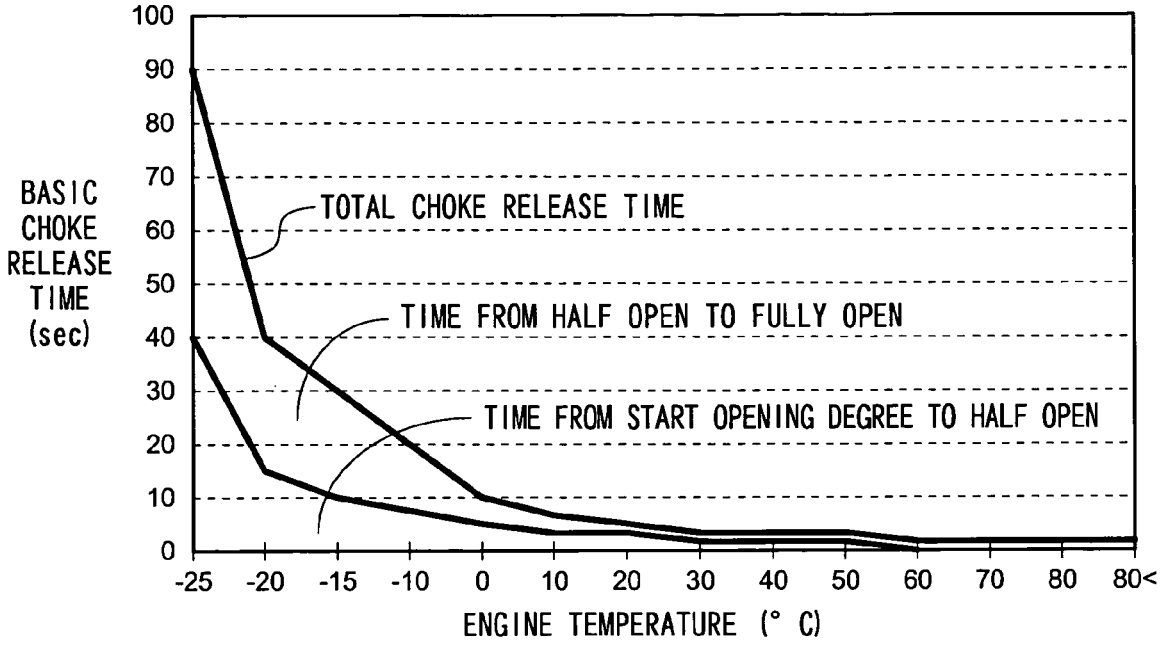
FIG. 8 is a graph showing an example of the choke release time corresponding to the engine temperature.

FIG. 8 shows the graph representing an example of FIG. 7. As this graph, the choke release time is determined due to the engine temperature upon start.

In this embodiment, the stepping motor is used as the driving source of the choke valve, but not limited to the stepping motor, for example, a servo motor may be similarly used.

The engine temperature is represented by the temperature of the cylinder head 2*a*, but the engine temperature for choke valve control is not limited to the temperature at this position. For example, a temperature sensor may be installed in an oil pan or water jacket for engine cooling water, and the temperature of lubricating oil or temperature of engine cooling water maybe detected, and used as engine temperature. Besides, any temperature information detected in engine case parts capable of representing the engine temperature may be employed in the choke valve control of the invention.

What is claimed is:

1. An automatic choke for controlling an opening degree of a choke valve provided in an intake passage of an engine upon start of the engine, comprising;

a stepping motor for controlling the opening degree of the choke valve, wherein the choke valve is driven to a fully closed side for initializing the stepping motor when a power source for starting the engine is turned on, wherein the opening degree of the choke valve upon start of engine is determined on the basis of a temperature information representing an engine temperature upon start of engine, a time until releasing the choke corresponding to fully opening the choke valve from the opening degree of the choke valve upon start of the engine is determined on the basis of the temperature information, wherein the engine is controlled to settle at a predetermined reference speed, and wherein a time until releasing the choke depends on the reference speed, and is determined to be shorter when the reference speed is higher, and longer when the reference speed is lower.

2. The automatic choke of claim 1, wherein the engine is coupled to a generator, and the power source for starting the engine is obtained from an output of the generator rotated by operation of a recoil starter provided for starting the engine.

3. An automatic choke for controlling an opening degree of a choke valve provided in an intake passage of an engine upon start of the engine, comprising;

a stepping motor for controlling the opening degree of the choke valve, wherein when a preset start opening degree of the choke valve is between a fully closed side and a reference opening degree, the choke valve is driven to the fully closed side for initializing the stepping motor when a power source for starting the engine is turned on, wherein the engine is controlled to settle at a predetermined reference speed, and wherein a time until releasing the choke depends on the reference speed, and is determined to be shorter when the reference speed is higher, and longer when the reference speed is lower.

4. The automatic choke of claim 3, wherein when the preset start opening degree of the choke valve is between a fully opened side and the reference opening degree, the choke valve is driven to the fully opened side for initializing the stepping motor.

5. The automatic choke of claim 3 or 4, wherein the start opening degree of the choke valve is determined on the basis of a temperature information representing an engine temperature.

6. The automatic choke of claim 3 or 4, wherein the engine is coupled to a generator, and the power source for starting the engine is obtained from the output of the generator rotated by operation of a recoil starter provided for starting the engine.

* * * * *